United States Patent [19]

Hoyer

[11] 4,262,951

[45] Apr. 21, 1981

[54] DEVICE FOR TRANSPORTING PREFABRICATED CONCRETE SECTIONS

[75] Inventor: Peter Hoyer, Memmingen, Fed. Rep. of Germany

[73] Assignee: Pfeifer Seil-Und Hebetechnik GmbH & Co., Fed. Rep. of Germany

[21] Appl. No.: 10,848

[22] Filed: Feb. 8, 1979

[30] Foreign Application Priority Data

Feb. 15, 1978 [DE] Fed. Rep. of Germany ..... 2806261

[51] Int. Cl.[3] ..... B66C 1/66

[52] U.S. Cl. ..... 294/89; 52/125; 294/82 R

[58] Field of Search ..... 294/78 R, 82 R, 89, 294/90; 52/125, 706

[56] References Cited

U.S. PATENT DOCUMENTS

| | | | |
|---|---|---|---|
| 3,499,676 | 3/1970 | Haeussler | 294/90 |
| 3,534,668 | 10/1970 | Scheincha | 52/125 X |
| 3,626,508 | 12/1971 | Sharrow | 294/89 |
| 3,916,590 | 11/1975 | Miller | 52/125 |

FOREIGN PATENT DOCUMENTS

| | | | |
|---|---|---|---|
| 261175 | 4/1968 | Austria | 294/89 |
| 2610195 | 9/1977 | Fed. Rep. of Germany | 294/89 |
| 82066 | 3/1962 | France | 52/125 |
| 157453 | 1/1957 | Sweden | 52/125 |

*Primary Examiner*—Johnny D. Cherry

*Attorney, Agent, or Firm*—Holman & Stern

[57] ABSTRACT

This invention is in an arrangement to facilitate the transporting of a prefabricated concrete component. The concrete component is provided with a wire rope-type anchoring element having an exposed loop situated within a hemispherical recess in the surface of the concrete component. A hook-like component is provided which is made of cast steel having a plate-like shape with a lifting hole at one end and a hook element at the other end. The hook part has a substantially spherical outer configuration and an inner bearing surface curved to receive the loop. A movable safety stud is provided over the opening of the hook to prevent inadvertent release of the hook from the wire loop. In this arrangement, the plane of the hook component is angled relative to a vertical axis through the wire loop element so that the upper eyelet part is effectively displaced from the hook entrance portion.

5 Claims, 10 Drawing Figures

DEVICE FOR TRANSPORTING PREFABRICATED CONCRETE SECTIONS

BRIEF SUMMARY OF THE INVENTION

The present invention relates to an arrangement for transporting a prefabricated concrete component having an anchoring element to be concreted into place in the component, the anchoring element forming a loop in a recess in the component by means of which the component may be lifted.

Arrangements for transporting prefabricated concrete components are already known. German Pat. No. 12 51 003 concerns the concreting in place of an anchorage shell in a prefabricated concrete component, the shell having an internal thread, into which the outer thread on a rope-mounted securing-shell can be screwed in position. Having secured the anchor shell against tearing away, for instance by linking with the reinforcement a reliable transport mechanism is achieved.

Other arrangements for this purpose are known, for example as described in German Offenlegungsschrift No. 2 316 986. This patent disclosed an anchor component to be concreted into place, projecting from a hemispherical recess in a prefabricated concrete component and having a thicker part therein for the purpose of linking a concrete component with a lifting device.

A similar arrangement is suggested in U.S. Pat. No. 1 957 235, in which a member with a transverse bore projects from a recess in a prefabricated concrete component into which member a hook is able to engage.

Transport arrangements of the aforesaid type have the advantage that the device linking the concrete component with the lifting means can be handled in a similar manner to a crane hook, the suspension orientation consequently being easily seen and controlled. Nevertheless a disadvantage is that the transfer of forces by means of the linking device or a stud or the like is limited. The dimensions of the device projecting from the recess in the prefabricated concrete component and forming an eyelet or a thicker component for gripping must naturally remain relatively small, in order to limit the dimensions of the recess or cavity. Such components are also highly sensitive to slanting tensile forces which forces are frequently unavoidable. There is a danger of undetected overloading, which may rapidly lead to fracture and eventually to accidents.

An object of the present invention is to achieve an arrangement for transporting prefabricated concrete components of the previously defined type, by means of which it is possible to use a hook-like member for linking with the lifting device, which can be easily handled and is simple to monitor in its correct operation, and by means of which relatively high forces can be directed into the concrete component without danger and with a minimum expenditure.

In accordance with the present invention there is provided an arrangement for transporting a prefabricated concrete component, consisting of an anchoring element to be concreted into place in the concrete component, the anchoring element forming a loop within a recess in the component with which a releasable hook-like component of lifting equipment is engageable, the hook-like component comprising an eyelet and a lower hook part, the outer configuration of the hook-part being essentially spherical and its inner, bearing surface being curved to receive said loop, the eyelet being plate-like in shape and having a hole by means of which, in use, the arrangement is liftable.

Both the curved bearing surface and the spherical hook part permit a matching of the recess in the prefabricated concrete component which allows good mobility of the hook part in relation to the various tensile directions, so that even extreme oblique tensile forces can be accommodated without the hook part bearing on the prefabricated concrete component and causing additional indefinable lifting forces. It is important that the loop in the concrete component allows for sufficient lateral movement. To this end, the loop preferably consists of wire rope. It has been found that it is possible to impart extremely high lifting forces into the prefabricated concrete component by means of a wire-rope, without fear of overloading possibly resulting in fracture. The specific strength of a wire rope material is much greater than that of a solid material, and the increased safety arises from the fact that in the event of overload only a number of rope strands will break, though not leading to a notching effect, whereas localised overloading of a solid material, more particularly high strength material will promptly result in a fracture.

Nevertheless it is necessary to use a relatively small section of the rope for the loop, since this determines the size of the complete hook-like component as well as of the recess.

In turn, providing that the lower hook part of the hook-like component is matched to the diameter of the eyelet, the forces in the hook-like component are easily contained and it is possible to produce a high quality cast steel hook-like component, thus excluding the necessity to use expensive forging operations. The spherical outer configuration of the hook part effectively matches the required mobility of the hook-like component in relation to the prefabricated concrete component on the one hand, and also provides a sufficient section in the more heavily loaded points of the hook-like component.

Generally speaking the hook-like component is used as a crane hook so that the danger of incorrect operation is relatively limited.

The hook-like component according to the invention is used preferably with a wire-rope loop. On the other hand, it is obvious that suitable reduction of the loads would also allow the wire-rope loop to be substituted by another material, as an example made from ordinary reinforced steel.

The invention suggests that the plane of the plate should match the plane of the eyelet. In this manner a plane of maximum mobility is clearly defined and can be seen externally without difficulty.

It is preferable that the plate widens out at the top, and that the smallest plate width effectively matches the ball diameter. In this manner any constriction of the hook-like component is avoided and a good flow of forces is achieved while avoiding localised overstressing.

The invention also proposes a safety means in the form of a drop-stud in the hook-opening, guided at the juncture between sphere and plate. This drop-stud must be raised to allow suspension of the hook-like component, then drops back into its safety position. It prevents the hook-like component from coming out of the correct suspension condition when it is not under load.

It has been found advantageous for the plane of the plate in the operational position to be slightly angled downwards, i.e. away from the hook opening. In this manner the mobility of the hook-like component is further increased in relation to the eyelet.

The wire-rope loop preferably forms part of a closed wire-rope which is concreted and thus anchored into place in the prefabricated concrete component. The loop may be formed by a ferrule, arranged so that it is located preferably opposite the wire-rope loop, thus serving as an anchorage.

The wire-rope loop may nevertheless also be formed by a hair-pin shaped wire-rope component, of which both ends of the rope component also preferably carry ferrules which are anchored at a suitable depth in the prefabricated concrete component.

BRIEF DESCRIPTION OF THE SEVERAL VIEWS OF THE DRAWINGS

The invention will now be described further by way of example with reference to the accompanying drawings in which.

DETAILED DESCRIPTION

Figure 1:
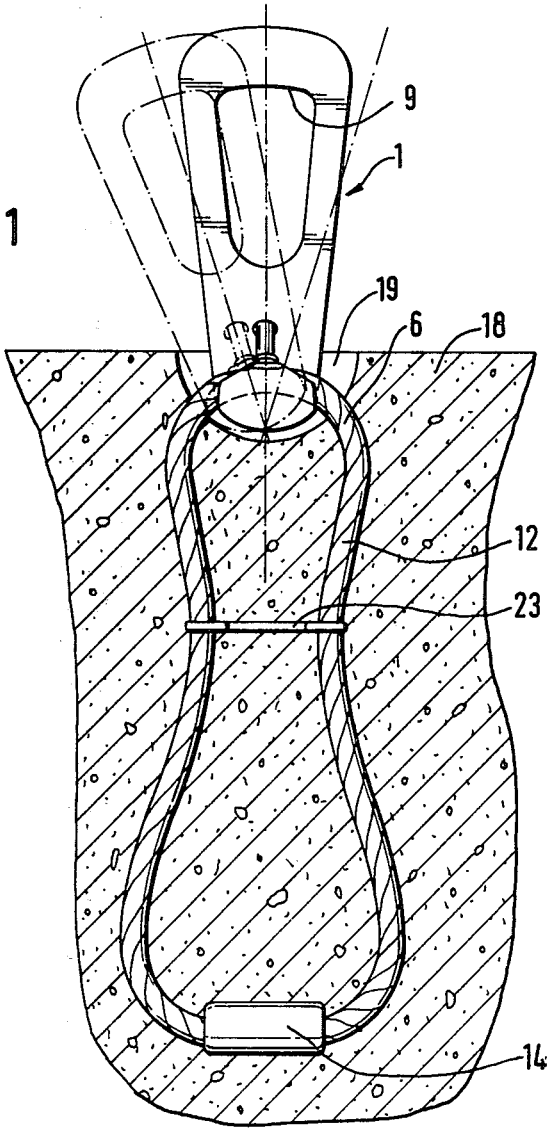
FIG. 1 is a front elevational view of an arrangement for transporting prefabricated concrete components according to the invention in an operative position.

In FIGS. 1 to 4 a hook-like component is designated generally 1. The component consists of an upper eyelet 3 (FIGS. 3 and 4) and a lower hook part 2 both of which are of cast steel. As shown more particularly in FIG. 3, the lower hook-part 2 has an external configuration 4 of essentially spherical shape. A hook-opening 11 is machined in the sphere, the opening being closed by a drop-stud 10. The drop-stud 10 is guided within a guide 15 at the juncture between hook and eyelet components. The drop-stud 10 can be lifted so that a loop 6 (FIG. 1) can be placed in the hook.

The bearing surface 5 for the loop 6 in the hook part 2, is curved about a centre of curvature 7 (FIGS. 3 and 4) the curvature being slightly less in vertical plane 16 of the hook part component, than laterally as at 17.

Figure 4:
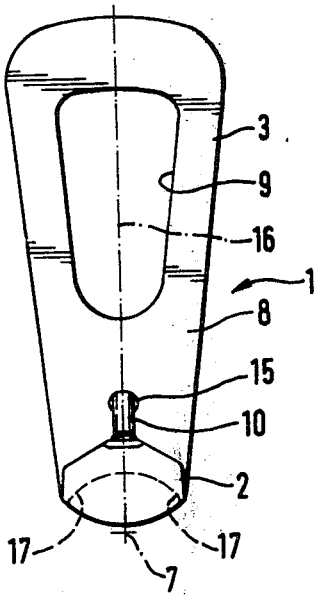
Figure 3:
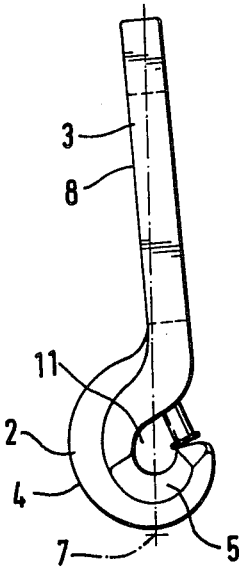

As clearly shown in FIGS. 1 and 4, the eyelet 3 is in the form of a plate 8 with a central hole 9. A hook of a crane or some other connecting means to lifting equipment (not shown) can engage in the plate hole 9.

A recess 19 is provided in a prefabricated concrete component 18, the recess having an approximately hemispherical form and in which the loop 6 of the wire-rope 12 (see FIG. 1) is located. Quite clearly the hook-like component 1 is capable of free swivelling movement and maintains a good mobility in the recess 19 in the plane shown in FIG. 1.

Figure 2:
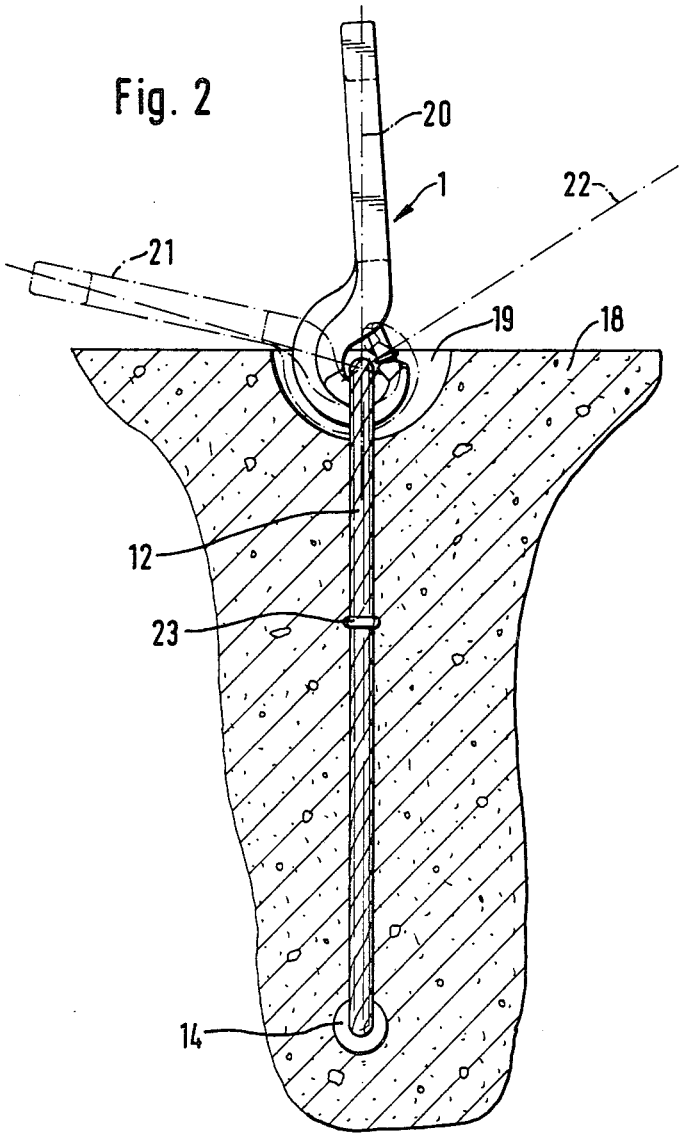
FIG. 2 is a side-view of the arrangement illustrated in FIG. 1, FIGS. 3 and 4 represent side and front views, respectively, of the hook-like component illustrated in FIGS. 1 and 2.

FIG. 2 shows that the plane of the plate 8 is slightly inclined in relation to the plane 20, formed by the loop 6 i.e. the wire rope 12. This inclination has the advantage that under particularly heavy loading conditions an extensive displacement of the hook-like component is possible, as indicated by the dotted lines 21 in FIG. 2. The possibility of applying tension obliquely in the other direction, that is along the dotted centre-line 22 in FIG. 2, is somewhat reduced but in practice this has not been found important.

In FIGS. 1 and 2, the loop 6 is formed by a wire-rope 12 the ends of which are connected together by means of a ferrule 14. The shape of the loop 6 is also determined by a clip 23 which distorts the loop into an elongated configuration.

The design shown in FIGS. 1 and 2 has the advantage that the ferrule 14 provides a deep-lying anchorage point in the concrete component, even in the absence of any connection between the loop 6 with any reinforcement of the prefabricated concrete component 18.

Figure 5:
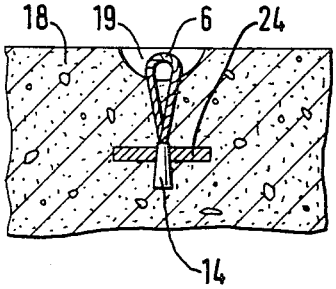
FIGS. 5 to 10 represent a number of designs of loop to be conreted into place in a component to be transported.

A modification on the wire-rope loop shown in FIGS. 1 and 2 is shown in FIG. 5. The ends of the wire rope are connected in side-by-side relationship in the manner of a tennis racket by a ferrule 14 with a conical outer surface. The ferrule is received in an aperture in a plate 24 and a good anchorage is achieved in the prefabricated concrete component for the wire-rope loop 6. The plate 24 may be replaced by a flat section, component, disc or the like.

Figure 6:
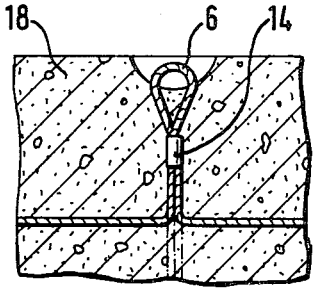

In the modification of FIG. 6 the wire-rope ends are brought right through the ferrule 14 and bent aside to a given depth in the prefabricated component 18. If desired, the free ends of the wire-rope may be terminated in further eyelets 6.

Figure 7:
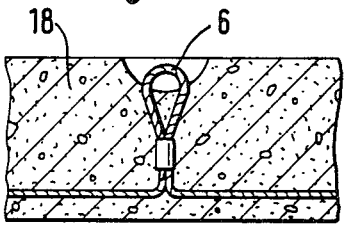

FIG. 7 shows a modification similar to that of FIG. 6 but with the wire rope embedded at a shallower depth in the concrete component.

Figure 8:
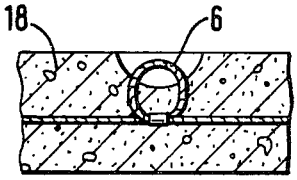

FIG. 8 shows a loop forming part of a continuous length of wire rope the base of which, as viewed, is connected together by a ferrule.

Figure 9:
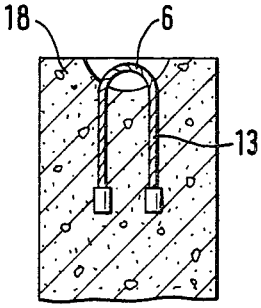
Figure 10:
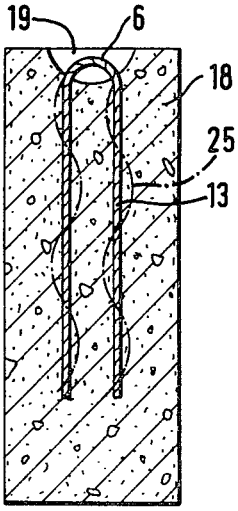

In the loop constructions illustrated in FIGS. 9 and 10 the wire-rope components 13 are hair-pin shaped. Whereas in the design illustrated in FIG. 9 the ends of the rope are received in ferrules 14, such ferrules are excluded in the design example of FIG. 10. In FIG. 10 the wire-rope is interwoven with a reinforcement mesh 25 for example.

What is claimed is:

1. In an arrangement for transporting a prefabricated concrete component having a wire type anchoring element concreted into place therein, the anchoring element forming a loop within a hemispherical recess in the component with which a releasable hook-like component of lifting equipment is engageable, the improvement of the hook-like component comprising an integral eyelet part and a lower hook part made of cast steel, the hook part having a substantially spherical outer configuration and an inner bearing surface which is curved to receive said loop, said curved inner bearing surface having substantially the same radius as the radius of the curve of said loop, so that said hook part is simultaneously movable in said recess along said wire and around said wire as a center of rotation resulting in the capability of a substantially universal movement of said hook-like component with respect to said concrete component, and the eyelet part being in the shape of a plate which widens upwardly and having a hole by means of which, in use, the arrangement can be lifted, the smallest width of said plate corresponding substantially to the outer configuration of said hook part.

2. An arrangement as set forth in claim 1 wherein said hook part has an open entrance portion and the plane of said eyelet part is angled relative to a vertical axis through the arrangement and thus is effectively displaced from the hook entrance.

3. An arrangement as set forth in claim 1 wherein the loop within the recess in the concrete component forms part of a closed wire rope.

4. An arrangement as set forth in claim 1 wherein the loop within the recess in the concrete component forms part of a hair pin shaped wire rope.

5. An arrangement as set forth in claim 1 wherein the anchoring element is a wire rope and, one or more ferrules anchor said rope in said concrete component.

* * * * *